US007959749B2

(12) United States Patent
Burns et al.

(10) Patent No.: US 7,959,749 B2
(45) Date of Patent: Jun. 14, 2011

(54) GAS GENERATING COMPOSITION

(75) Inventors: Sean P. Burns, Oakland, MI (US); Slaven Domazet, Sterling Heights, MI (US)

(73) Assignee: TK Holdings, Inc., Armada, MI (US)

( * ) Notice: Subject to any disclaimer, the term of this patent is extended or adjusted under 35 U.S.C. 154(b) by 980 days.

(21) Appl. No.: 11/701,028

(22) Filed: Jan. 31, 2007

(65) Prior Publication Data

US 2007/0175553 A1 Aug. 2, 2007

Related U.S. Application Data

(60) Provisional application No. 60/764,087, filed on Jan. 31, 2006.

(51) Int. Cl.

| | |
|---|---|
| ***C06B 29/00*** | (2006.01) |
| ***C06B 29/02*** | (2006.01) |
| ***C06B 29/08*** | (2006.01) |
| ***C06B 29/12*** | (2006.01) |
| ***C06D 5/00*** | (2006.01) |
| ***C06D 5/06*** | (2006.01) |

(52) U.S. Cl. ..... 149/77; 149/75; 149/82; 149/83; 60/205

(58) Field of Classification Search ..... 149/19.6, 149/36, 75, 77, 82–83; 264/3.4; 60/205
See application file for complete search history.

(56) References Cited

U.S. PATENT DOCUMENTS

| | | | | |
|---|---|---|---|---|
| 3,785,149 | A * | 1/1974 | Timmerman | 60/205 |
| 3,880,595 | A | 4/1975 | Timmerman | 23/281 |
| 3,902,934 | A * | 9/1975 | Timmerman | 149/83 |
| 3,923,884 | A | 12/1975 | Yonemitsu et al. | 260/536 |
| 3,964,255 | A * | 6/1976 | Catanzarite | 60/205 |
| 4,152,891 | A * | 5/1979 | Garner | 60/205 |
| 5,035,757 | A | 7/1991 | Poole | 149/46 |
| 5,084,118 | A | 1/1992 | Poole | 149/22 |
| 5,139,588 | A | 8/1992 | Poole | 149/61 |
| 5,380,380 | A | 1/1995 | Poole et al. | 149/22 |
| 5,386,775 | A | 2/1995 | Poole et al. | 102/289 |
| 5,460,668 | A | 10/1995 | Lyon | 149/36 |
| 5,460,671 | A | 10/1995 | Khandhadia | 149/109.6 |
| 5,514,230 | A | 5/1996 | Khandhadia et al. | 149/36 |
| 5,531,941 | A | 7/1996 | Poole | 264/3.4 |
| 5,538,567 | A | 7/1996 | Henry, III et al. | 149/18 |
| 5,545,272 | A | 8/1996 | Poole et al. | 149/48 |
| 5,567,905 | A * | 10/1996 | Barnes et al. | 102/289 |
| 5,670,740 | A * | 9/1997 | Barnes et al. | 149/62 |
| 5,756,929 | A | 5/1998 | Lundstrom et al. | 149/22 |
| 5,763,821 | A * | 6/1998 | Wheatley | 149/19.5 |
| 5,783,773 | A | 7/1998 | Poole | 149/36 |

(Continued)

OTHER PUBLICATIONS

MSDS sheets and Pricing for D-, L-, and DL-tartaric acid obtained from Aldrich Sigma company.*

(Continued)

*Primary Examiner* — Anthony J Green
*Assistant Examiner* — Pegah Parvini
(74) *Attorney, Agent, or Firm* — L.C. Begin & Associates, PLLC.

(57) ABSTRACT

A gas generating composition of the present invention contains at least one fuel selected from carboxylic acids, salts of carboxylic acids, and polymers; at least one perchlorate salt; and/or at least one metal oxide or metal hydroxide. A gas generating system 200 containing a gas generant in accordance with the present invention is also contemplated.

9 Claims, 2 Drawing Sheets

U.S. PATENT DOCUMENTS

| | | | | |
|---|---|---|---|---|
| 5,827,996 | A * | 10/1998 | Yoshida et al. | 149/45 |
| 5,866,842 | A * | 2/1999 | Wilson et al. | 149/19.6 |
| 5,872,329 | A | 2/1999 | Burns et al. | 149/36 |
| 5,962,808 | A | 10/1999 | Lundstrom | 149/19.1 |
| 6,007,647 | A | 12/1999 | Burns et al. | 149/36 |
| 6,074,502 | A | 6/2000 | Burns et al. | 149/36 |
| 6,077,371 | A | 6/2000 | Lundstrom et al. | 149/37 |
| 6,123,359 | A * | 9/2000 | Cabrera et al. | 280/741 |
| 6,210,505 | B1 | 4/2001 | Khandhadia et al. | 149/36 |
| 6,287,400 | B1 | 9/2001 | Burns et al. | 149/36 |
| 6,306,232 | B1 | 10/2001 | Khandhadia et al. | 149/22 |
| 6,475,312 | B1 | 11/2002 | Burns et al. | 149/109.6 |
| 6,620,266 | B1 | 9/2003 | Williams et al. | 149/3 |
| 6,789,485 | B2 | 9/2004 | Moquin et al. | 102/530 |
| 6,887,326 | B2 | 5/2005 | Williams et al. | 149/109.6 |
| 7,094,296 | B1 | 8/2006 | Williams et al. | 149/19.2 |
| 2004/0016480 | A1 | 1/2004 | Williams et al. | 149/46 |
| 2005/0067074 | A1 | 3/2005 | Hinshaw et al. | 149/45 |
| 2005/0161135 | A1 | 7/2005 | Williams et al. | |
| 2005/0230017 | A1 | 10/2005 | Williams et al. | |
| 2005/0235863 | A1 | 10/2005 | Stevens | |
| 2005/0257866 | A1 | 11/2005 | Williams et al. | |
| 2005/0263223 | A1 | 12/2005 | Halpin et al. | |
| 2005/0272873 | A1 | 12/2005 | Miller et al. | |
| 2006/0022443 | A1 | 2/2006 | Stevens et al. | |
| 2006/0043716 | A1 | 3/2006 | Quioc et al. | |
| 2006/0118218 | A1 | 6/2006 | Burns et al. | |
| 2006/0219340 | A1 | 10/2006 | Dunham et al. | |
| 2007/0034307 | A1 | 2/2007 | Hordos | |
| 2007/0040167 | A1 | 2/2007 | Miller et al. | |
| 2007/0044675 | A1 | 3/2007 | Burns et al. | |
| 2007/0084531 | A1 | 4/2007 | Halpin et al. | |
| 2007/0084532 | A1 | 4/2007 | Burns et al. | |
| 2007/0169863 | A1 | 7/2007 | Hordos et al. | 149/37 |
| 2008/0271825 | A1 | 11/2008 | Halpin et al. | 149/45 |

OTHER PUBLICATIONS

U.S. Appl. No. 09/638,606, Burns et al.
U.S. Appl. No. 11/264,982, Miller et al.
U.S. Appl. No. 11/264,983, Miller et al.
U.S. Appl. No. 11/479,493, Burns et al.
U.S. Appl. No. 11/699,712, Miller.
U.S. Appl. No. 11/701,028, Burns et al.
Office Action U.S. Appl. No. 11/217,577, filed Jul. 7, 2008, Dated for Nov. 10, 2010 (02130).
Office Action U.S. Appl. No. 11/656,319, filed Jan. 19, 2007, Dated for Sep. 21, 2010 (141).
Office Action U.S. Appl. No. 11/699,712, Filed Jan. 29, 2007, Mar. 1, 2011 (142).
Office Action No. U.S. Appl. No. 11/656,319, Filed Jan. 19, 2007, Dated for Mar. 16, 2007 (141).
Office Action No. U.S. Appl. No. 11/699,712, Filed Jan. 29, 2007, Dated for Mar. 1, 2011 (142).
Office Action No. U.S. Appl. No. 12/217,477, Filed Jun. 7, 2008, Dated for Apr. 4, 2011 (02130).

* cited by examiner

GAS GENERATING COMPOSITION

CROSS-REFERENCE TO RELATED APPLICATIONS

The present application claims the benefit of U.S. Provisional Application No. 60/764,087 having a filing date of Jan. 31, 2006.

TECHNICAL FIELD

The present invention relates generally to gas generating systems, and to gas generating compositions employed in gas generator devices for automotive restraint systems, for example.

BACKGROUND OF THE INVENTION

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are hereby incorporated by reference.

In addition to a fuel constituent, pyrotechnic nonazide gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. When employed in a vehicle occupant protection system, the solids produced as a result of combustion must be filtered and otherwise kept away from contact with the occupants of the vehicle. It is therefore highly desirable to develop compositions that produce a minimum of solid particulates while still providing adequate quantities of a nontoxic gas to inflate the safety device at a high rate. With regard to nontoxic gas, it is desirable to reduce or eliminate certain gaseous species including nitrogen oxides.

Known pyrotechnic non-azide gas generants sometimes are disadvantaged by generating relatively higher levels of CO, NH3, NO, and NO2. The oxygen balance can be adjusted to minimize either CO, or NO and NO2. However, if CO is low then NO and NO2 will typically be relatively high. On the other hand, if NO and NO2 are low, then CO will typically be relatively high. Accordingly, there is a need for a gas generant composition that forms low levels of these gases.

Yet another concern includes sustaining combustion with regard to gas generating compositions used in linear inflators, or inflators employed for rollover or head curtain application. Certain compositions including perchlorate salts and nonmetallic fuels are desirable. However, one challenge with these types of compositions is to improve combustion propagation throughout the length of the inflator, such as a linear inflator typically employed as a rollover or head curtain cushion. Another concern is to reduce the relative hygroscopicity of these gas generants.

Accordingly, ongoing efforts in the design of automotive gas generating systems, for example, include other initiatives that reconcile the need for reasonable amounts of gas produced the drawbacks mentioned above.

SUMMARY OF THE INVENTION

A gas generating composition is provided that resolves the concerns described above. Accordingly, gas generants of the present invention include a fuel selected from carboxylic acids, salts thereof, polymers, and mixtures thereof. A first oxidizer is selected from metal and nonmetal perchlorate salts. As described below, depending on the fuel employed, a second oxidizer may be selected from at least one of the group of metal oxides, metal hydroxides, and mixtures thereof. Either the first or second oxidizer may be employed independently, rather than as co-oxidizers, depending on the fuel employed in the composition, a salt of carboxylic acid for example.

DETAILED DESCRIPTION OF THE PREFERRED EMBODIMENTS

Figure 1:
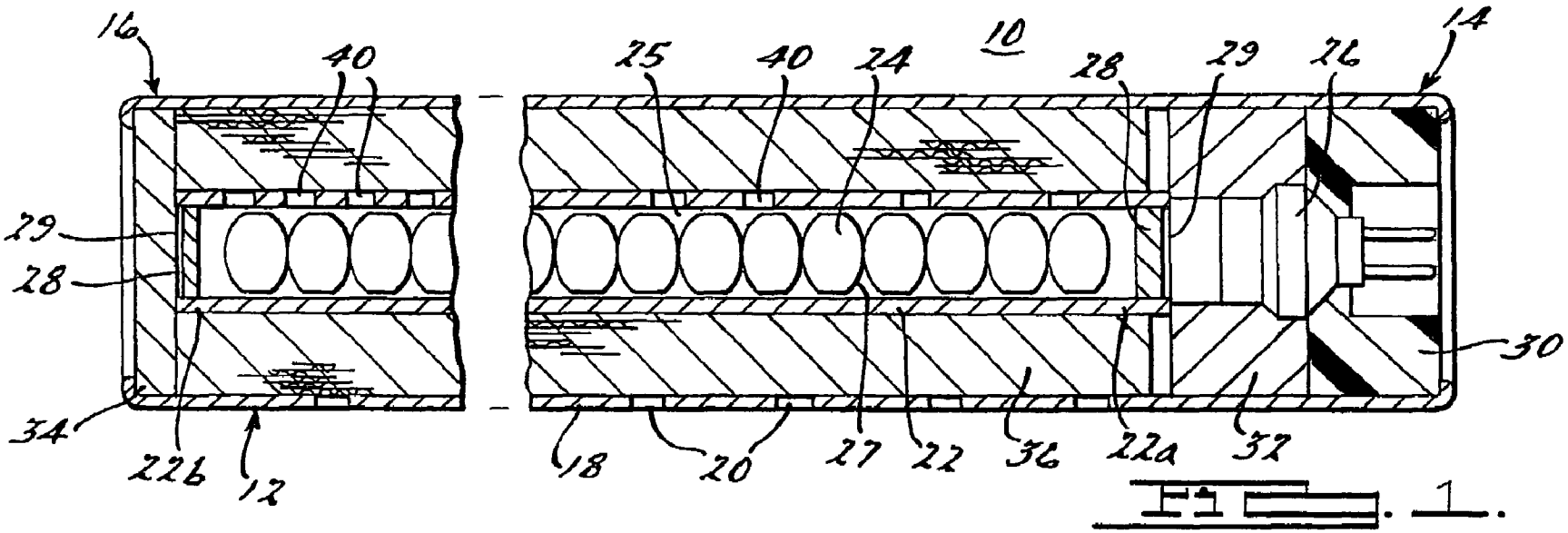
FIG. 1 is an exemplary inflator incorporating a composition of the present invention.

The above-referenced concerns are addressed by gas generating systems including a gas generant composition that contain no nitrogen-containing compounds.

Accordingly, the compositions of the present invention contain non-nitrogen oxidizers. These oxidizers are selected from the group including perchlorates such as metal perchlorates including alkali metal and alkaline earth metal perchlorates; and metal oxides and hydroxides including transitional metal oxides and hydroxides; and mixtures thereof. Exemplary oxidizers include potassium perchlorate, copper (II) oxide, iron (III) oxide, and copper (II) hydroxide. When employed, perchlorate salts, metal oxide(s), metal hydroxide (s), and mixtures thereof are generally individually provided at about 0.1 to 86 wt % of the total gas generating composition. The total oxidizer component, that is the perchlorate salt plus any oxide or hydroxide, is preferably provided at about 38-90% by weight of the gas generant composition. When employing carboxylic acids such as DL-tartaric acid, it has been found that employing potassium perchlorate, and a secondary oxidizer selected from metal oxides, metal hydroxides, and mixtures thereof produces desirable combustion results and ballistic performance in accordance with the present invention.

It has also been discovered that when employing salts of carboxylic acids, such as the 1 potassium salt of DL-tartaric acid, either oxidizer may be employed with useful results. As such, in this case, when the potassium hydrogen salt of tartaric acid (KH-TTA) is used for example, only a perchlorate salt such as potassium perchlorate as a first oxidizer, or, a metal oxide, metal hydroxide, or mixture thereof as a second oxidizer may be separately and effectively employed as the sole oxidizer of the composition if desired. Accordingly, when in the context of employing salts of carboxylic acids, the percent range of the oxidizer may range from 38-86 wt %. and the range of each oxidizer individually employed may range from 0.1-86 wt %

A non-nitrogen fuel is also included. The non-nitrogen-containing fuel is selected from the group including carboxylic acids, salts of carboxylic acids, and polymers. Exemplary fuels include tartaric acid and its isomers, succinic acid, fumaric acid, glutamic acid, adipic acid, mucic acid, monopotassium tartrate, carboxymethyl cellulose, cellulose acetate butyrate, and silicone. The total fuel component is preferably provided at about 10-50% by weight of the gas generant composition. When only one oxidizer is employed, in the case of employing a salt of carboxylic acid for example, then the desired fuel range is about 10-62 wt %.

A non-nitrogen processing aid may also be employed including metal oxides, silicates, natural minerals, and lubricants. Exemplary processing aids include silica, fumed silica, alumina, potassium silicates, talcs, clays, micas, graphite, and stearates that may be provided at about 0-15 wt % of the total gas generating composition, and more preferably at about 0-5 wt %.

Accordingly, the present invention includes a gas generant formulation that has no nitrogen-containing compounds. Upon combustion, no NH3, NO, or NO2 is thereby formed. Because the compounds in the formulations described may contain carbon, hydrogen, and oxygen, the primary gases formed upon combustion will be H2O and CO2. To minimize the formation of undesirable CO, the oxygen balance of the formulation can be adjusted to a positive level. As such, gas generants of the present invention are formulated to exhibit a 0% to +10% weight percent oxygen.

In yet another aspect of the invention, the present compositions may be employed within a gas generating system. For example, a vehicle occupant protection system made in a known way contains crash sensors in electrical communication with an airbag inflator in a steering wheel or otherwise within the vehicle, and also with a seatbelt assembly. The gas generating compositions of the present invention may be employed in both subassemblies within the broader vehicle occupant protection system or gas generating system. More specifically, each gas generator employed in the automotive gas generating system may contain a gas generating composition as described herein.

The compositions may be dry or wet mixed using methods known in the art. The various constituents are generally provided in particulate form and mixed to form a uniform mixture with the other gas generant constituents. The mixture is then pelletized or formed into other useful shapes in a safe manner known in the art.

It should be noted that all percents given herein are weight percents based on the total weight of the gas generant composition. The chemicals described herein may be provided by known suppliers such as Aldrich Chemical Company and Polysciences, Inc. or Fisher Chemical Company, for example.

It will be appreciated that in accordance with the present invention, the present gas generating compositions improve the combustion propagation throughout the length of the inflator while minimizing the total solids produced. As a result, the manufacture of a linear inflator for example is substantially simplified by obviating the need to mechanically design for improved combustion propagation. As shown in the following examples, the ignitability and/or burn rate (or sustained combustion), is improved with the addition of metal oxides, and in particular, with the addition of iron (III) oxide or cobalt (II) oxide.

EXAMPLE 1

A gas generating composition containing 56.12 wt % potassium perchlorate, 43.63 wt % DL-tartaric acid, and 0.25 wt % graphite, dry mixed and comminuted in a known manner, was formed into gas generant pellets. The BOE Impact H50 (inches) was greater than 32. The BAM Friction (N) was greater than 360. The weight percent (wt %) loss after 400 hours at 107 C was 0.1%.

EXAMPLE 2

A gas generating composition containing 60.00 wt % potassium chlorate, 38.50 wt % DL-tartaric acid, 1.00 wt % M5 silica, and 0.50 wt % graphite, dry mixed and comminuted in a known manner, was formed into gas generant pellets. The BOE Impact H50 (inches) was 2.1. The BAM Friction (N) was 128. The weight percent (wt %) loss after 400 hours at 107 C was 22.3%. This example illustrates how the use of a chlorate salt inhibits the thermal stability of the respective gas generant composition, and also presents a more sensitive gas generant composition.

EXAMPLE 3

A gas generating composition containing 42.0 wt % potassium perchlorate, 20.0 wt % potassium chlorate, 23.0 wt % DL-tartaric acid, and 15.0 wt % succinic acid, dry mixed and comminuted in a known manner, was formed into gas generant pellets. The BOE Impact H50 (inches) was 4.8. The BAM Friction (N) was 288. The weight percent (wt %) loss after 400 hours at 107 C was 2.9%. This example illustrates how the use of a chlorate salt inhibits the thermal stability of the respective gas generant composition, and also presents a more sensitive gas generant composition.

EXAMPLE 4

A gas generating composition containing 54.0 wt % potassium perchlorate, and 46.0 wt % DL-tartaric acid was ground, dry mixed, and comminuted in a known manner, and was then formed into gas generant pellets. When combusted, it was observed that the ignitability was relatively poor and the composition did not sustain combustion or sustain a constant burn rate.

EXAMPLE 5

A gas generating composition containing 54.0 wt % potassium perchlorate, and 46.0 wt % DL-tartaric acid was ground, dry mixed, and comminuted in a known manner. Copper (II) oxide ("special" ultra fine from Goldschmidt at less than 25 microns) was then added at about 15% of the weight of the fuel and oxidizer combined, and homogeneously mixed therein. The composition was then formed into gas generant pellets. When combusted, it was observed that the ignitability was relatively good, and the composition exhibited slow sustained combustion.

EXAMPLE 6

A gas generating composition containing 54.0 wt % potassium perchlorate, and 46.0 wt % DL-tartaric acid was ground, dry mixed, and comminuted in a known manner. Tungsten (VI) oxide powder (20 micron from Aldrich) was then added at about 15% of the weight of the fuel and oxidizer combined, and homogeneously mixed therein. The composition was then formed into gas generant pellets. When combusted, it was observed that the ignitability was relatively good, and the composition exhibited slow sustained combustion.

EXAMPLE 7

A gas generating composition containing 54.0 wt % potassium perchlorate, and 46.0 wt % DL-tartaric acid was ground, dry mixed, and comminuted in a known manner. Zinc oxide, 99+%, ACS Reagent (from Aldrich) was then added at about 15% of the weight of the fuel and oxidizer combined, and homogeneously mixed therein. The composition was then formed into gas generant pellets. When combusted, it was observed that the ignitability was relatively good, and the composition exhibited slow sustained combustion.

EXAMPLE 8

A gas generating composition containing 54.0 wt % potassium perchlorate, and 46.0 wt % DL-tartaric acid was ground, dry mixed, and comminuted in a known manner. Manganese (IV) oxide (from Aldrich at less than 5 microns) was then added at about 15% of the weight of the fuel and oxidizer combined, and homogeneously mixed therein. The composition was then formed into gas generant pellets. It was observed that the ignitability was relatively good, and the composition exhibited slow sustained combustion.

EXAMPLE 9

A gas generating composition containing 54.0 wt % potassium perchlorate, and 46.0 wt % DL-tartaric acid was ground, dry mixed, and comminuted in a known manner. Molybdenum (VI) Trioxide, 99.5+%, ACS (from Aldrich) was then added at about 15% of the weight of the fuel and oxidizer combined, and homogeneously mixed therein. The composition was then formed into gas generant pellets. It was observed that the ignitability was relatively good, and the composition exhibited slow sustained combustion.

EXAMPLE 10

A gas generating composition containing 54.0 wt % potassium perchlorate, and 46.0 wt % DL-tartaric acid was ground, dry mixed, and comminuted in a known manner. Bismuth (III) Oxide powder, 99.9% (from Aldrich at less than 10 microns) was then added at about 15% of the weight of the fuel and oxidizer combined, and homogeneously mixed therein. The composition was then formed into gas generant pellets. It was observed that the ignitability was relatively good, and the composition exhibited slow sustained combustion.

EXAMPLE 11

A gas generating composition containing 54.0 wt % potassium perchlorate, and 46.0 wt % DL-tartaric acid was ground, dry mixed, and comminuted in a known manner. Tin (IV) Oxide, −325 mesh, 99.9% (from Aldrich at less than 45 microns) was then added at about 15% of the weight of the fuel and oxidizer combined, and homogeneously mixed therein. The composition was then formed into gas generant pellets. It was observed that the ignitability was relatively good, and the composition exhibited slow sustained combustion.

EXAMPLE 12

A gas generating composition containing 54.0 wt % potassium perchlorate, and 46.0 wt % DL-tartaric acid was ground, dry mixed, and comminuted in a known manner. Cobalt (II) Oxide, −325 mesh (from Aldrich at less than 45 microns) was then added at about 15% of the weight of the fuel and oxidizer combined, and homogeneously mixed therein. The composition was then formed into gas generant pellets. It was observed that the ignitability was relatively good, and the composition exhibited relatively fast sustained combustion.

EXAMPLE 13

A gas generating composition containing 54.0 wt % potassium perchlorate, and 46.0 wt % DL-tartaric acid was ground, dry mixed, and comminuted in a known manner. Iron (III) Oxide, 99%+ (from Aldrich at less than 5 microns) was then added at about 15% of the weight of the fuel and oxidizer combined, and homogeneously mixed therein. The composition was then formed into gas generant pellets. It was observed that the ignitability was relatively good, and the composition exhibited relatively fast sustained combustion.

EXAMPLE 14

A gas generating composition containing 54.0 wt % potassium perchlorate, and 46.0 wt % DL-tartaric acid was ground, dry mixed, and comminuted in a known manner. Iron (III) Oxide Bayoxide ER (from Lanxess at about one micron) was then added at about 15% of the weight of the fuel and oxidizer combined, and homogeneously mixed therein. The composition was then formed into gas generant pellets. It was observed that the ignitability was relatively excellent, and the composition exhibited relatively very fast sustained combustion.

EXAMPLE 15

A gas generating composition containing 57.05 wt % strontium nitrate, 28.95 wt % 5-aminotetrazole, 6.00 wt % potassium 5-aminotetrazole, and 8.00 wt % clay was ground, dry mixed, and comminuted in a known manner. The composition was then formed into gas generant pellets. Upon combustion, as measured by DSC analysis, the composition produced 347 ppm of carbon monoxide, 30 ppm of ammonia, 89 ppm of nitrogen monoxide, and 18 ppm of nitrogen dioxide. The airborne particulates measured 33 mg/cubic meter. This example illustrates that gas generants that are typically employed in gas generators are sometimes disadvantaged with trace amounts of ammonia, nitrogen monoxide, and nitrogen dioxide. The calculated amounts of gaseous effluents include about 56.9% nitrogen, 17.8% carbon dioxide, 25.6% water vapor, and 5.6% oxygen, whereas the nitrogen results in nitrogen monoxide, nitrogen dioxide, and ammonia in competing reactions.

EXAMPLE 16

A gas generating composition containing 45.00 wt % potassium perchlorate, 44.70 wt % 1K-TTA, 10.00 wt % copper oxide special, and 0.30 wt % graphite was ground, dry mixed, and comminuted in a known manner. The composition was then formed into gas generant pellets. Upon combustion, as measured by DSC analysis, the composition produced 191 ppm of carbon monoxide, 0 ppm of ammonia, 7 ppm of nitrogen monoxide, and 0 ppm of nitrogen dioxide. The airborne particulates measured 46 mg/cubic meter. This example illustrates how nitrogen oxides and ammonia are substantially eliminated from the gaseous effluent. The calculated amounts of gaseous effluents include about 58.6% carbon dioxide, 35.7% water vapor, and 5.6% oxygen

EXAMPLE 17

A gas generating composition containing 61.00 wt % potassium perchlorate, 33.00 wt % DL-TTA, 5.00 wt % iron (III) oxide, 0.5 wt % M5 silica, and 0.50 wt % graphite was ground, dry mixed, and comminuted in a known manner. The composition was then formed into gas generant pellets. Upon combustion, as measured by DSC analysis, the composition produced 300 ppm of carbon monoxide, 0 ppm of ammonia, 0 ppm of nitrogen monoxide, and 0 ppm of nitrogen dioxide. The airborne particulates measured 12 mg/cubic meter. Again, this example illustrates how nitrogen oxides and ammonia are substantially eliminated from the gaseous effluent. The calculated amounts of gaseous effluents include about 48.8% carbon dioxide, 35.0% water vapor, and 16.2% oxygen.

It should be emphasized that in none of the examples 1-14, 16, and 17 were nitrogen-containing gaseous combustion products calculated as products of the respective combustion reactions. Further, as shown in examples 16 and 17, when actually combusted, no nitrogen-containing species resulted. It should be further appreciated that the carbon monoxide may be attenuated by tailoring the oxygen balance of each respective composition to optimize the oxidation of carbon monoxide to carbon dioxide. Eliminating the nitrogen from the reactants obviates the problem of increased amounts of nitrogen-containing species when carbon monoxide is attenuated by tailoring the oxygen balance. Other benefits include readily available and inexpensive raw materials, and reduced sensitivity of the gas generant constituents for enhanced process safety. It is believed that the use of metal oxides or metal hydroxides, as shown in the examples, improves the ballistic performance thereby facilitating the use of these perchlorate oxidizers and enabling the elimination of nitrogen-containing reactants.

As shown in FIG. 1, an exemplary inflator incorporates a dual chamber design to tailor the force of deployment an associated airbag. In general, an inflator, containing a primary autoigniting gas generating composition 12 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

FIG. 1 shows a cross-sectional view of an exemplary inflator 10 in accordance with the present invention. Inflator 10 is preferably constructed of components made from a durable metal such as carbon steel or iron, but may also include components made from tough and impact-resistant polymers, for example. One of ordinary skill in the art will appreciate various methods of construction for the various components of the inflator. U.S. Pat. Nos. 5,035,757, 6,062,143, 6,347,566, U.S. Patent Application Serial No. 2001/0045735, WO 01/08936, and WO 01/08937 exemplify typical designs for the various inflator components, and are incorporated herein by reference in their entirety, but not by way of limitation.

Referring to FIG. 1, inflator 10 includes a tubular housing 12 having a pair of opposed ends 14, 16 and a housing wall 18. Housing 12 may be cast, stamped, extruded, or otherwise metal-formed. A plurality of gas exit apertures 20 are formed along housing wall 18 to permit fluid communication between an interior of the housing and an airbag (not shown).

A longitudinal gas generant enclosure 22 is inwardly radially spaced from housing 12 and is coaxially oriented along a longitudinal axis of the housing. Enclosure 22 has an elongate, substantially cylindrical body defining a first end 22*a*, a second end 22*b*, and an interior cavity for containing a gas generant composition 24 therein. Enclosure first end 22*a* is positioned to enable fluid communication between an igniter 26 and the enclosure interior cavity. Enclosure 22 is configured to facilitate propagation of a combustion reaction of gas generant 24 along the enclosure, in a manner described in greater detail below.

A plurality of gas generant tablets 24 are stacked side by side along the length of enclosure 22. Each tablet 24 preferably has substantially the same dimensions. In one embodiment, each gas generant tablet 24 has an outer diameter of ¼" and a pair of opposing, generally dome-shaped faces 27, providing a maximum tablet width of approximately 0.165" between faces. As seen in FIG. 1, tablets 24 are shaped or configured to advantageously create a cavity 25 between adjacent tablets 24. These cavities 25 provide a volume of air space relative within enclosure 22, thereby enhancing the burn characteristics of tablets 24 when they are ignited. An alternative arrangement of the gas generant along the length of the enclosure may be provided. However, any arrangement of gas generant along the enclosure preferably provides a substantially uniform average distribution of gas generant along the length of the enclosure.

A quantity of a known auto-ignition composition 28 is positioned at either end of the stack of gas generant material 24. Enclosure 22 is environmentally sealed at both ends with an aluminum tape 29 or any other effective seal.

An igniter 26 is secured to inflator 10 such that the igniter is in communication with an interior of gas generant enclosure 22, for activating the inflator upon occurrence of a crash event. In the embodiment shown, igniter 26 is positioned within an annular bore of an igniter closure 30. Igniter 26 may be formed as known in the art. One exemplary igniter construction is described in U.S. Pat. No. 6,009,809, herein incorporated by reference.

Igniter closure 30 is crimped or otherwise fixed to a first end 14 of housing 12. A first endcap 32 is coaxially juxtaposed adjacent igniter closure 30 to form, in conjunction with igniter closure 30, an inner housing for igniter 26. First endcap 32 also provides a closure for gas generant enclosure 22. A second endcap 34 is crimped or otherwise fixed to a second end 16 of housing 12. Endcaps 32 and 34 and igniter closure 30 may be cast, stamped, extruded, or otherwise metal-formed. Alternatively, endcaps 32 and 34 may be molded from a suitable polymer.

A filter 36 may be incorporated into the inflator design for filtering particulates from gases generated by combustion of gas generant 24. In general, filter 36 is positioned between gas generant 24 and apertures 20 formed along inflator housing wall 18. In the embodiment shown in FIG. 1, filter 36 is positioned exterior of gas generant enclosure 22 intermediate enclosure 22 and housing wall 18, and substantially occupies the annular space between gas generant enclosure 22 and housing wall 18. In an alternative embodiment (not shown), filter 36 is positioned in the interior cavity of enclosure 22 between gas generant 14 and enclosure gas exit apertures 40 formed along enclosure 22. The filter may be formed from one of a variety of materials (for example, a carbon fiber mesh or sheet) known in the art for filtering gas generant combustion products.

In accordance with the present invention, a plurality of gas exit apertures 40 is particularly formed along enclosure 22 to tailor the rate of propagation of a combustion reaction of the gas generant 24 along the enclosure, as required by design criteria. Apertures 40 are spaced apart along enclosure 22. Enclosure 22 may be roll formed from sheet metal and then perforated to produce apertures 40. Enclosure apertures 40 may be environmentally sealed with an aluminum tape 42 or any other effective seal. The size of enclosure apertures 40 and the spacing between the apertures may be determined based on design requirements such as combustion propagation, thereby further enhancing the combustion propagation of the propellant 24.

Figure 2:
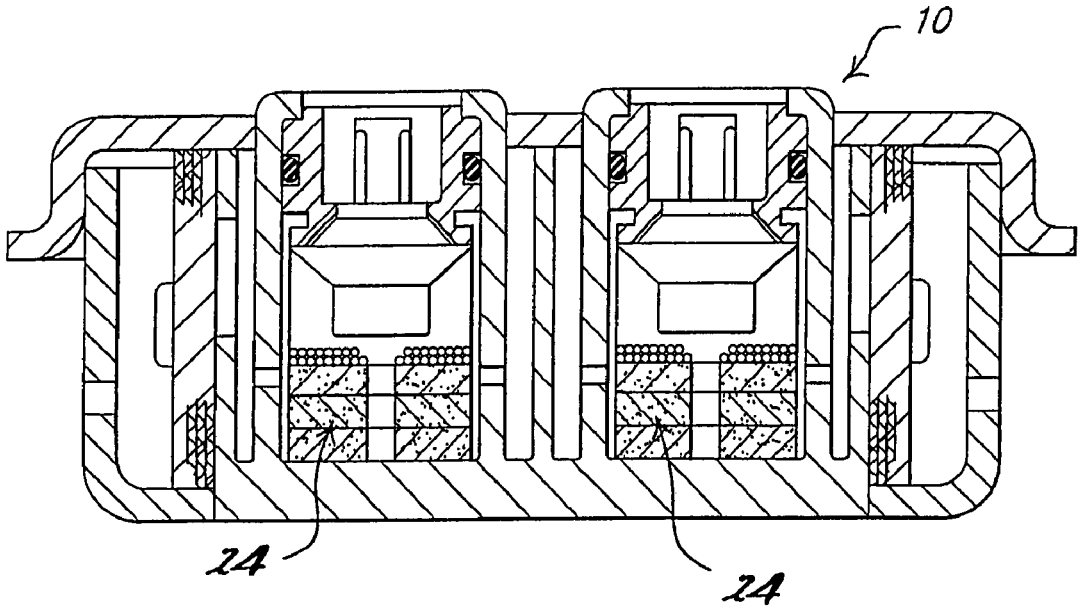
FIG. 2 is another exemplary inflator incorporating a composition of the present invention.

As shown in FIG. 2, another exemplary inflator incorporates a dual chamber design to tailor the force of deployment an associated airbag. In general, an inflator, containing a gas generating composition 24 formed as described herein, may be manufactured as known in the art. U.S. Pat. Nos. 6,422,601, 6,805,377, 6,659,500, 6,749,219, and 6,752,421 exemplify typical airbag inflator designs and are each incorporated herein by reference in their entirety.

Figure 3:
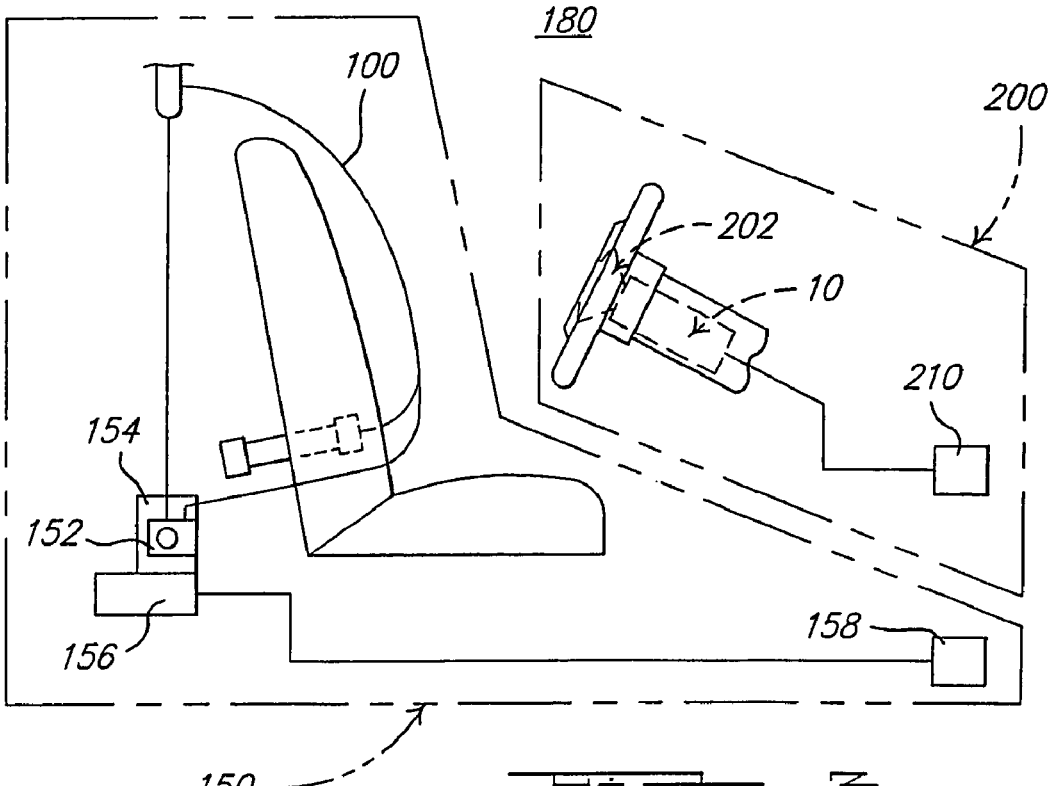
FIG. 3 is an exemplary gas generating system, in this case a vehicle occupant protection system, incorporating the inflator of FIG. 1.

Referring now to FIG. 3, the exemplary inflators 10 described in FIGS. 1 and 2 may also be incorporated into a gas generating system such as an airbag or vehicle occupant protection system 200. Airbag system 200 includes at least one airbag 202 and an inflator 10 containing a gas generant composition 12 in accordance with the present invention, coupled to airbag 202 so as to enable fluid communication with an interior of the airbag. Airbag system 200 may also include (or be in communication with) a crash event sensor 210. Crash event sensor 210 communicates with a known crash sensor algorithm that signals actuation of airbag system 200 via, for example, activation of airbag inflator 10 in the event of a collision.

Referring again to FIG. 3, airbag system 200 may also be incorporated into a broader, more comprehensive vehicle occupant restraint system 180 including additional elements such as a safety belt assembly 150. FIG. 3 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing propellant 12 and autoignition 14 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in operable communication with) a crash event sensor 158 (for example, an inertia sensor or an accelerometer, not shown) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

The present description is for illustrative purposes only, and should not be construed to limit the breadth of the present invention in any way. Thus, those skilled in the art will appreciate that various modifications could be made to the presently disclosed embodiments without departing from the scope of the present invention.

What is claimed is:

1. A gas generant composition comprising:

a fuel selected from the group consisting of carboxylic acids, salts of carboxylic acids, and polymers thereof;

a metal perchlorate salt at about 36-86 weight percent of the total composition; and an oxidizer selected from the group consisting of a transitional metal oxide, a transitional metal hydroxide, and mixtures thereof, wherein said gas generant composition contains no nitrogen.

2. The gas generant composition of claim 1 wherein said fuel is selected from the group consisting of 1-potassium salt of DL-tartaric acid, tartaric acid, succinic acid, fumaric acid, glutamic acid, adipic acid, mucic acid, monopotassium tartrate, carboxymethyl cellulose, cellulose acetate butyrate, and silicone.

3. The gas generant composition of claim 1 wherein said fuel is selected from the group consisting of polymers and carboxylic acids and is provided at about 10-50 weight percent of the total composition.

4. The gas generant composition of claim 1 wherein said metal perchlorate salt is selected from the group consisting of alkali metal and alkaline earth metal perchlorates, and mixtures thereof.

5. The gas generant composition of claim 1 wherein said oxidizer is selected from the group consisting of copper (II) oxide, iron (III) oxide, and copper (II) hydroxide.

6. The gas generant composition of claim 1 further comprising a non-nitrogen processing aid selected from the group consisting of metal silicates, natural minerals, and lubricants.

7. The gas generant composition of claim 6 wherein said non-nitrogen processing aid is selected from the group consisting of silica, fumed silica, alumina, potassium silicates, talcs, clays, micas, graphite, and stearates.

8. An inflator containing the gas generant composition of claim 1.

9. A vehicle occupant protection system containing the gas generant composition of claim 1.

* * * * *